United States Patent [19]

Henderson

[11] 4,287,815

[45] Sep. 8, 1981

[54] COVER ASSEMBLY FOR ATTIC FANS

[76] Inventor: Richard E. Henderson, 1400 Liggett Rd., Blue Springs, Mo. 64015

[21] Appl. No.: 101,427

[22] Filed: Dec. 10, 1979

[51] Int. Cl.[3] ..... F24F 7/00

[52] U.S. Cl. ..... 98/43 R; 49/463; 98/29

[58] Field of Search ..... 98/43 R, 1, 122, 29; 415/121 R; 150/52 R; 49/463, 465, 466, 61; 182/77

[56] References Cited

U.S. PATENT DOCUMENTS

| | | | |
|---|---|---|---|
| 2,598,610 | 5/1952 | Satz et al. | 49/61 X |
| 2,837,021 | 6/1958 | McLarty | 98/43 |
| 3,388,520 | 6/1968 | Perry | 49/465 X |
| 3,858,355 | 1/1975 | Root | 49/463 |
| 4,051,770 | 10/1977 | Felter et al. | 98/72 X |
| 4,103,701 | 8/1978 | Jeng | 150/52 R X |

FOREIGN PATENT DOCUMENTS

| | | | |
|---|---|---|---|
| 2157384 | 5/1973 | Fed. Rep. of Germany | 98/43 |
| 1363626 | 5/1964 | France | 49/463 |
| 642651 | 7/1962 | Italy | 182/77 |

*Primary Examiner*—Albert J. Makay
*Assistant Examiner*—Harold Joyce
*Attorney, Agent, or Firm*—Schmidt, Johnson, Hovey & Williams

[57] ABSTRACT

A cover assembly for an attic fan or the like permanently mounted in a wall or ceiling is provided which permits quick, easy covering of the fan opening when the fan is not in use during wintertime. The cover assembly is provided with heat insulation and a peripheral seal so that heat loss through the fan opening is minimized. In preferred forms, the cover assembly includes an insulated shell having a circumscribing lip which is adapted for face-to-face mounting adjacent the rim or flange of the fan assembly; a plurality of spring clips are employed for interconnecting the shell lip and fan rim for assuring a tight covering fit over the fan opening.

1 Claim, 3 Drawing Figures

COVER ASSEMBLY FOR ATTIC FANS

TECHNICAL FIELD

This invention relates to a cover which can be quickly and easily installed over an attic fan, for example, when the latter is not in use so as to prevent heat losses through the fan opening. More particularly, it is concerned with an insulated fan cover unit which can be placed over a fan opening in a manner to achieve a tight fit so that the opening is effectively blocked during periods when the fan is not in use.

BACKGROUND ART

Attic and wall fans are a common feature of many homes, and serve during periods of hot weather to provide much needed ventilation. In many cases such fan assemblies are provided with louvers which can be closed when the fan is not in use. However, it has been found that these louvers, which are usually of metallic construction, are not really effective in preventing heat losses through the fan opening. Thus, in the case of an attic fan mounted in a ceiling opening, expensive heat can be lost through the closed louvers.

It is therefore the most important object of the present invention to provide a cover assembly for use with an attic fan or the like permanently mounted adjacent an opening in a wall or ceiling, in order to permit full, insulated coverage of the fan opening during seasons of the year when the fan is not in use so that heat losses through the fan opening are eliminated or at least minimized.

As a corollary to the foregoing, another object of the invention is to provide a fan cover assembly which includes a shell of dimensions to cover the fan opening and which is filled with a heat insulation material, along with means for securing the cover over the fan opening to maximize its effectiveness.

DETAILED DESCRIPTION

Figure 1:
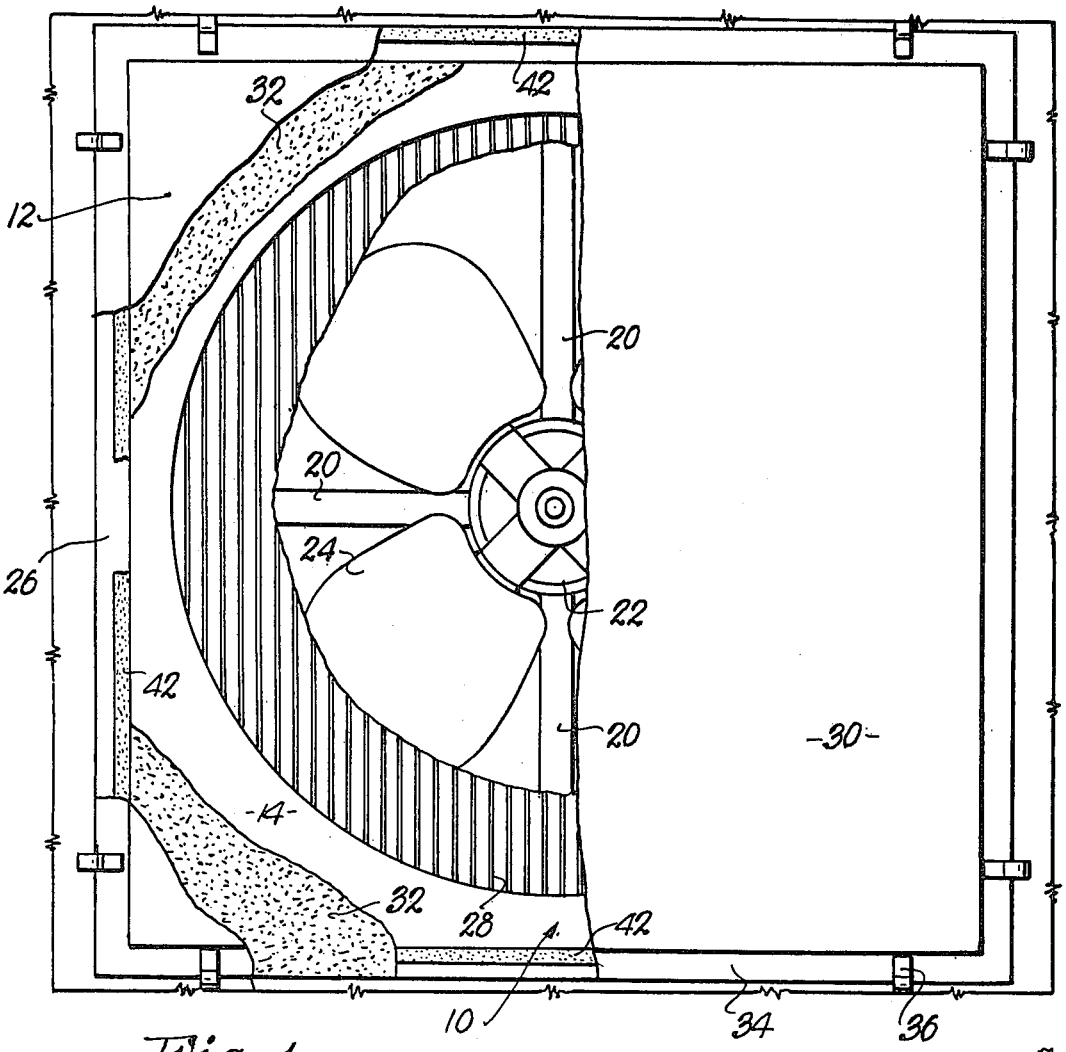
FIG. 1 is a bottom view with parts broken away for clarity of an attic fan assembly mounted adjacent an opening in a ceiling and having the cover assembly of the present invention operatively secured to the fan assembly.

A conventional attic fan 10 is illustrated along with the cover assembly 12 of the present invention operatively mounted onto fan 10. The attic fan 10 is of conventional construction and is mounted adjacent to and within an opening 14 provided for this purpose in a ceiling 16 or other appropriate structure. In this regard, the fan 10 includes the usual circumscribing frame 18, four spaced, upwardly extending struts 20, a drive motor 22, and the usual blade 24 coupled to motor 22. In addition, a circumscribing, laterally extending rim 26 is provided with frame 18 for engaging the lower surface of the ceiling 16. A series of side-by-side, shiftable, metallic louvers 28 are disposed across the air inlet face of fan 10. These louvers 28 are of conventional construction and are adapted to open during operation of fan 10 and close when the fan is at rest.

Cover assembly 12 includes a shell 30 formed of any suitable material which is of dimensions to cover the opening 14. In addition, the shell 30 presents a recess which receives suitable heat insulation material 32 such as form or fiberglass insulation. The shell 30 also includes a circumscribing, laterally and outwardly extending peripheral lip 34 which is located such that the lip 34 and rim 26 are in opposed face-to-face relationship when the cover assembly 12 is operatively mounted.

Figure 3:
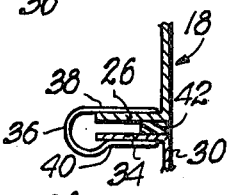
FIG. 3 is an enlarged fragmentary view in vertical section which illustrates the connection between the fan and cover assemblies and the preferred spring clip elements used for effecting the interconnection.
Figure 2:
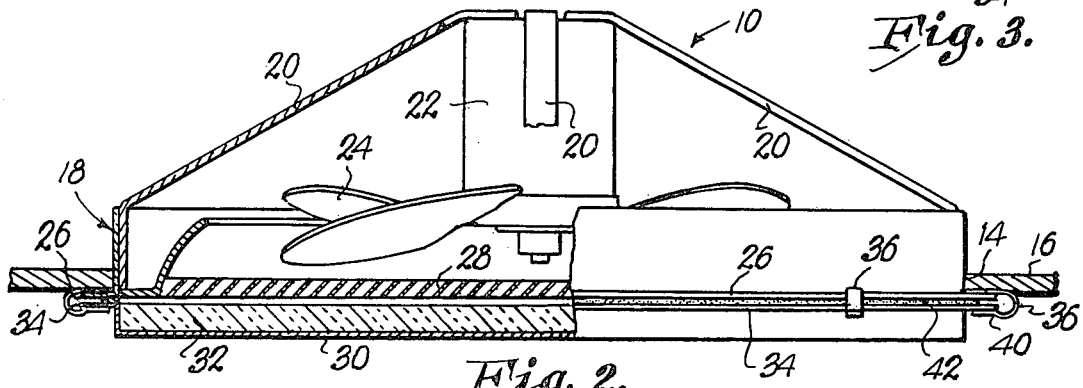
FIG. 2 is a side view in partial vertical section and with parts broken away for clarity of the fan and cover assembly illustrated in FIG. 1.

Means are also provided for securing the shell 30 in covering disposition to the opening 14. Preferably, the securing means includes a plurality of spring clip elements 36 (see FIG. 3) which are disposed in spaced relationship about the periphery of the shell 30. As illustrated, the spring clip elements 36 include respective legs 38 and 40 which are adapted to engage the rim 26 and lip 34 for resiliently urging these elements together. In this regard, a resilient rubber-like peripheral seal 42 is preferably disposed between the rim 26 and lip 34 for the purpose of further increasing the integrity of the seal therebetween.

In use when it is desired to mount the cover assembly 12 onto a fan or the like, it is only necessary to place the shell 30 in covering disposition to the opening 14, whereupon the spring clips 36 can be used to secure the insulated shell in place. Use of the cover assembly 12 serves to greatly minimize heat loss through the opening 14. In the case of the illustrated attic fan for example, rising currents of hot air are prevented from passing through the opening 14 and into the unheated attic thereabove. As a consequence, heating bills are lowered and energy is conserved.

Having thus described the invention, what is claimed as new and desired to be secured by Letters Patent is:

1. A cover assembly for a fan assembly mounted in an opening in a ceiling, the fan assembly including a vertical frame having a peripheral, laterally extending, normally horizontal rim in face to face engagement with the ceiling circumscribing said opening, the cover assembly comprising:

a shell of dimensions to cover the opening in the ceiling provided for said fan assembly, the shell having a normally horizontal main panel of essentially the same size as said opening, a wall circumscribing said main panel and extending from said panel toward said ceiling in substantial alignment with said frame and a normally horizontal lip circumscribing said wall and extending outwardly therefrom in face to face relationship with said rim when the shell is in place;

said main panel and said wall defining a recess in the shell extending away from said opening and in facing relationship thereto when the cover assembly is in place;

heat insulating material within said recess and filling the same to a level coincident with the plane of said lip;

sealing means between said lip and said rim when the cover assembly is in place; and means engaging said lip and said rim for securing the cover assembly to the frame.

* * * * *